US012114759B1

(12) United States Patent
McDougald

(10) Patent No.: US 12,114,759 B1
(45) Date of Patent: Oct. 15, 2024

(54) PORTABLE WIG AND HAIR DRESSING STAND

(71) Applicant: Kelly McDougald, East Hartford, CT (US)

(72) Inventor: Kelly McDougald, East Hartford, CT (US)

( * ) Notice: Subject to any disclaimer, the term of this patent is extended or adjusted under 35 U.S.C. 154(b) by 205 days.

(21) Appl. No.: 17/740,483

(22) Filed: May 10, 2022

(51) Int. Cl.
*A45D 44/10* (2006.01)

(52) U.S. Cl.
CPC ..... *A45D 44/10* (2013.01)

(58) Field of Classification Search
CPC ..... A45D 44/10
See application file for complete search history.

(56) References Cited

U.S. PATENT DOCUMENTS 1,791,348 A * 2/1931 Lester ..... A45D 19/04 4/522
2,107,962 A * 2/1938 Hugh ..... A47C 20/047 5/189
2,161,590 A * 6/1939 Rickard ..... A47K 1/08 4/575.1
3,026,537 A * 3/1962 Schnell ..... A45D 19/08 4/523
3,029,107 A * 4/1962 Myers ..... B60N 2/882 297/399
3,296,634 A * 1/1967 Rusnak ..... A47C 7/383 5/639
4,030,781 A * 6/1977 Howard ..... A47C 7/383 297/410
5,177,823 A * 1/1993 Riach ..... A61G 15/125 5/636
5,709,649 A * 1/1998 Chitwood ..... A61F 5/04 128/845
6,463,597 B2 10/2002 Ishimura
6,669,300 B1 * 12/2003 Lee ..... B60N 2/882 297/397
D489,922 S 5/2004 Choi
D537,142 S * 2/2007 Eagan ..... D21/803
7,673,356 B1 * 3/2010 Conyers ..... A45D 44/10 5/636
9,751,438 B2 * 9/2017 Dunham ..... A47C 7/383
10,470,561 B2 11/2019 Clegg
10,602,838 B2 3/2020 Ou
2002/0067063 A1 * 6/2002 Taborro ..... A47C 7/383 297/393
2005/0225137 A1 * 10/2005 Mead ..... A47D 13/107 297/250.1
2006/0250015 A1 * 11/2006 Buck ..... B60N 2/882 297/397
2008/0149802 A1 6/2008 Chiang
(Continued)

*Primary Examiner* — Tri M Mai

(57) ABSTRACT

The portable wig and hairdressing stand is a workbench. The portable wig and hairdressing stand is adapted for use with a cosmetic specialist. The portable wig and hairdressing stand is adapted for use with the hair of a client. The hair of the client is selected from the group consisting of the hair growing on the client and a hairpiece on a wig stand. The portable wig and hairdressing stand comprises a headrest structure, a pedestal structure, and a hook and loop structure. The pedestal structure attaches to the headrest structure. The hook and loop structure attaches to the headrest structure. The headrest structure forms a platform used by the cosmetic specialist to work on the hair of the client.

8 Claims, 4 Drawing Sheets

(56) References Cited

U.S. PATENT DOCUMENTS

| | | | | |
|---|---|---|---|---|
| 2009/0218376 | A1 | 9/2009 | King | |
| 2013/0312192 | A1* | 11/2013 | Lee | A47C 7/425 5/639 |
| 2021/0052065 | A1 | 2/2021 | Lundin | |

* cited by examiner

PORTABLE WIG AND HAIR DRESSING STAND

CROSS REFERENCES TO RELATED APPLICATIONS

Not Applicable

STATEMENT REGARDING FEDERALLY SPONSORED RESEARCH

Not Applicable

Reference to Appendix

Not Applicable

BACKGROUND OF THE INVENTION

Field of the Invention

The present invention relates to the field of tables. (A47B3/10)

SUMMARY OF INVENTION

The portable wig and hairdressing stand is a workbench. The portable wig and hairdressing stand is adapted for use with a cosmetic specialist. The portable wig and hairdressing stand is adapted for use with the hair of a client. The hair of the client is selected from the group consisting of the hair growing on the client and a hairpiece on a wig stand. The portable wig and hairdressing stand comprises a headrest structure, a pedestal structure, and a hook and loop structure. The pedestal structure attaches to the headrest structure. The hook and loop structure attaches to the headrest structure. The headrest structure forms a platform used by the cosmetic specialist to work on the hair of the client.

These together with additional objects, features and advantages of the portable wig and hairdressing stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable wig and hairdressing stand in detail, it is to be understood that the portable wig and hairdressing stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable wig and hairdressing stand.

It is therefore important that the claims be regarded as including such equivalent construction insofar as they do not depart from the spirit and scope of the portable wig and hairdressing stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
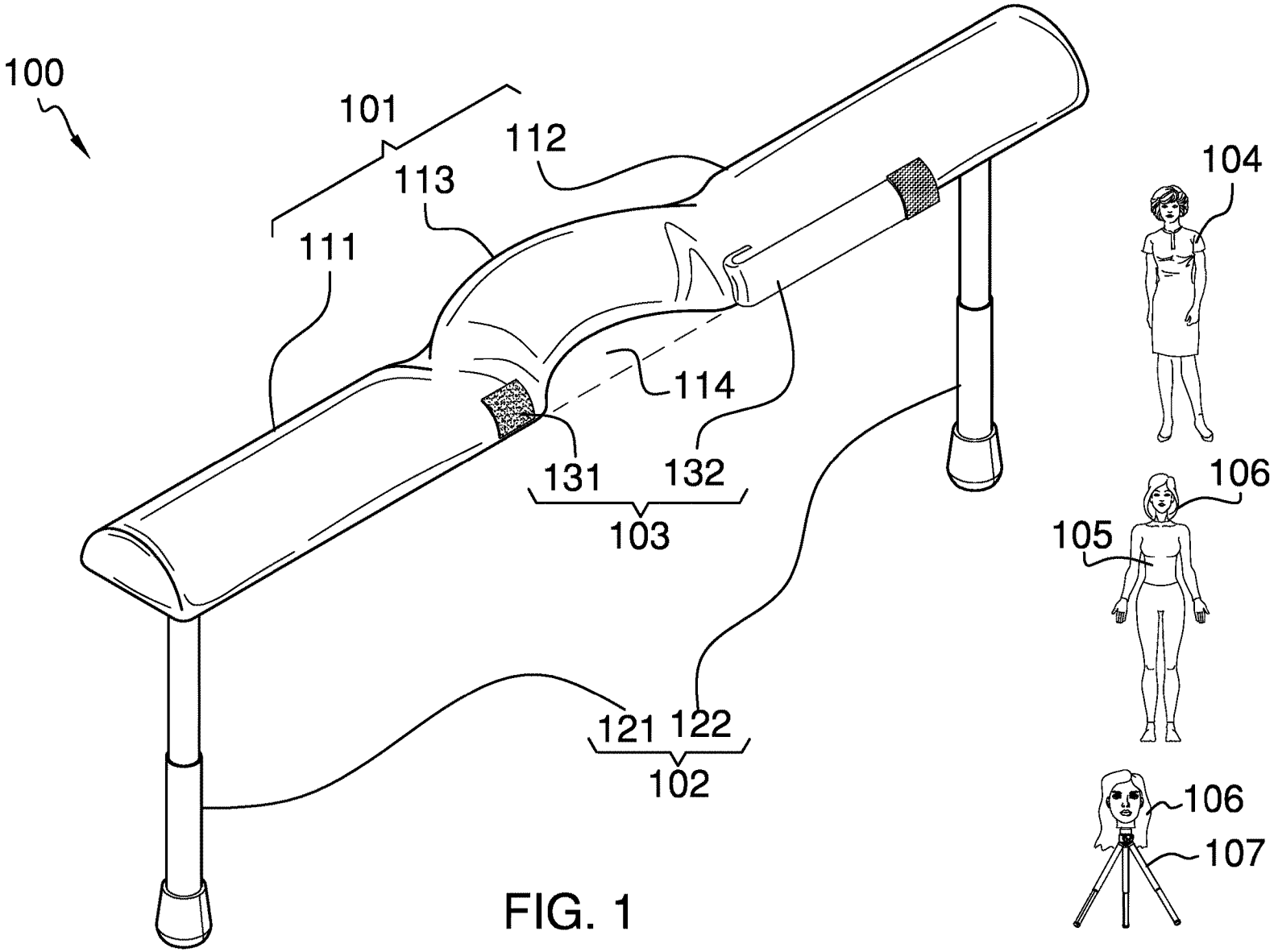
FIG. 1 is a perspective view of an embodiment of the disclosure.
Figure 2:
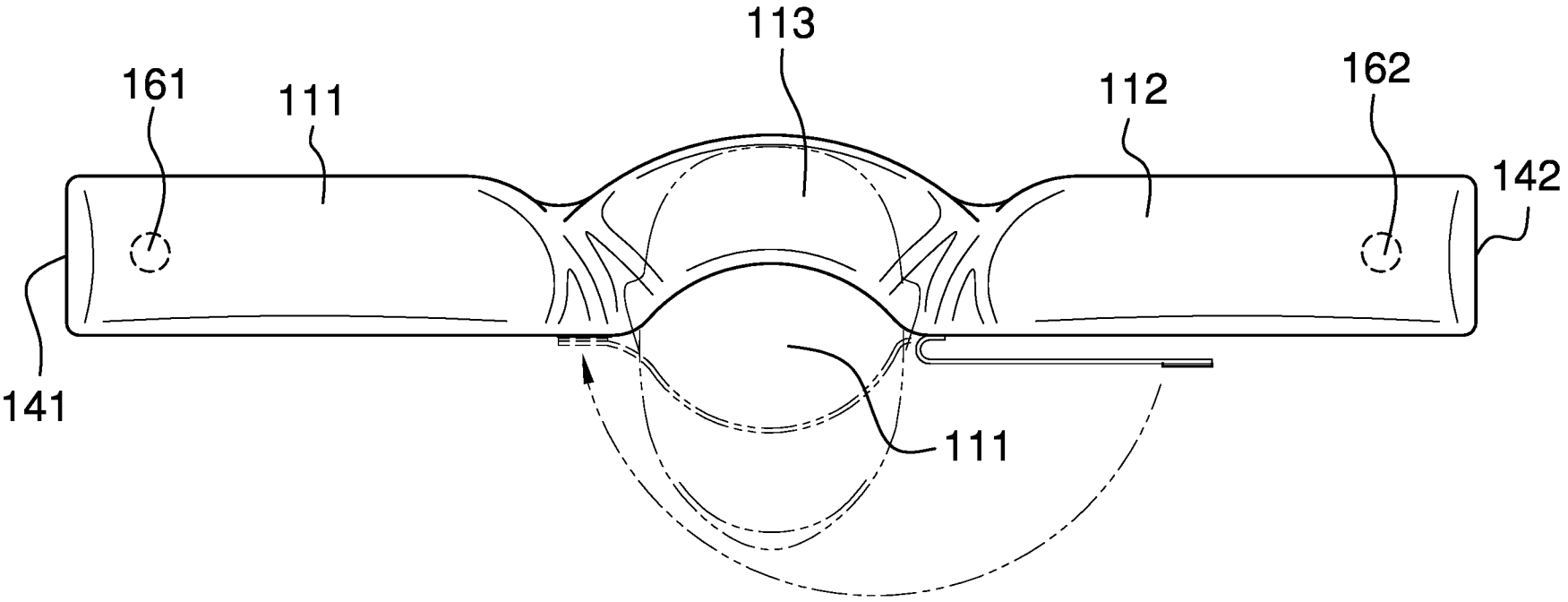
FIG. 2 is a top view of an embodiment of the disclosure.
Figure 3:
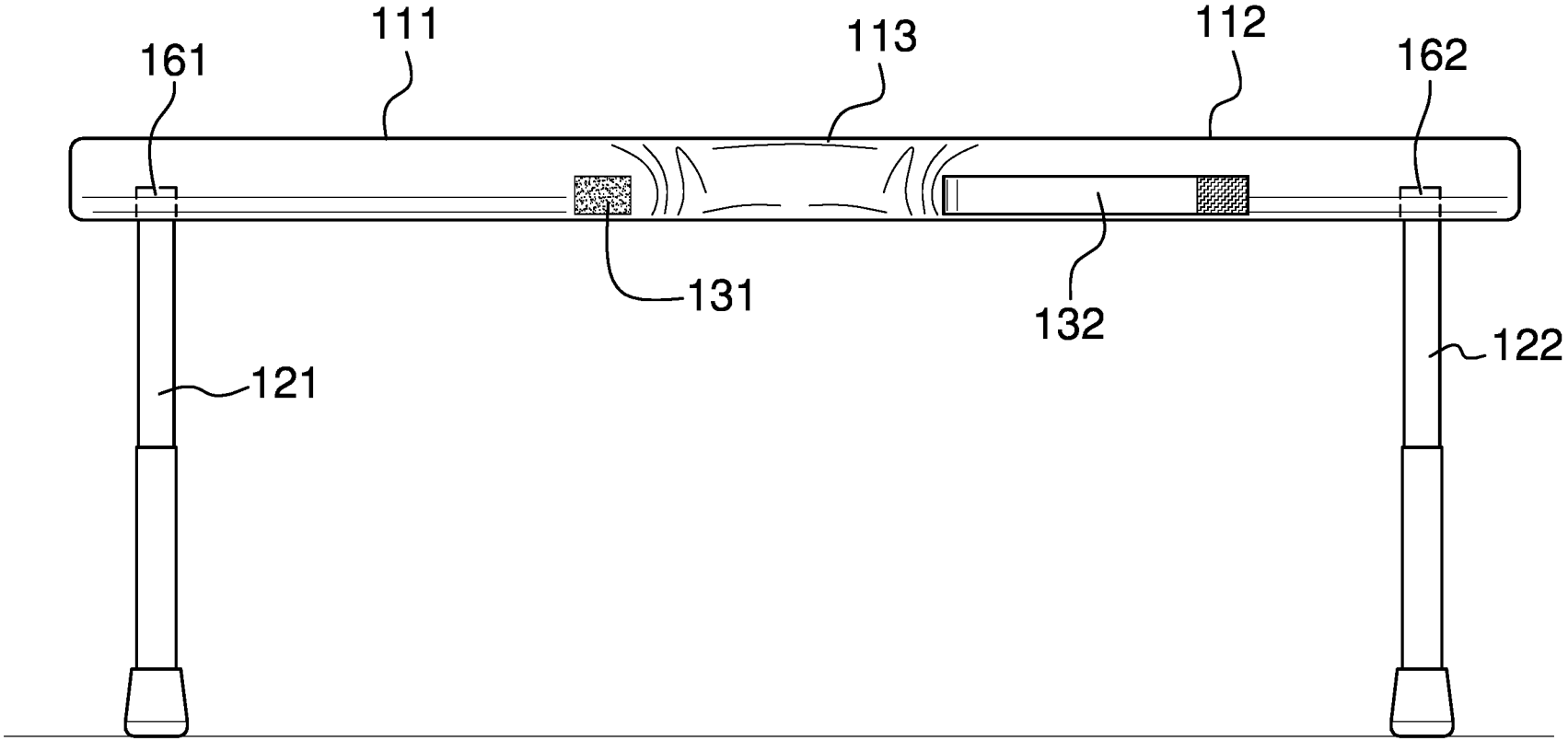
FIG. 3 is a front view of an embodiment of the disclosure.
Figure 4:
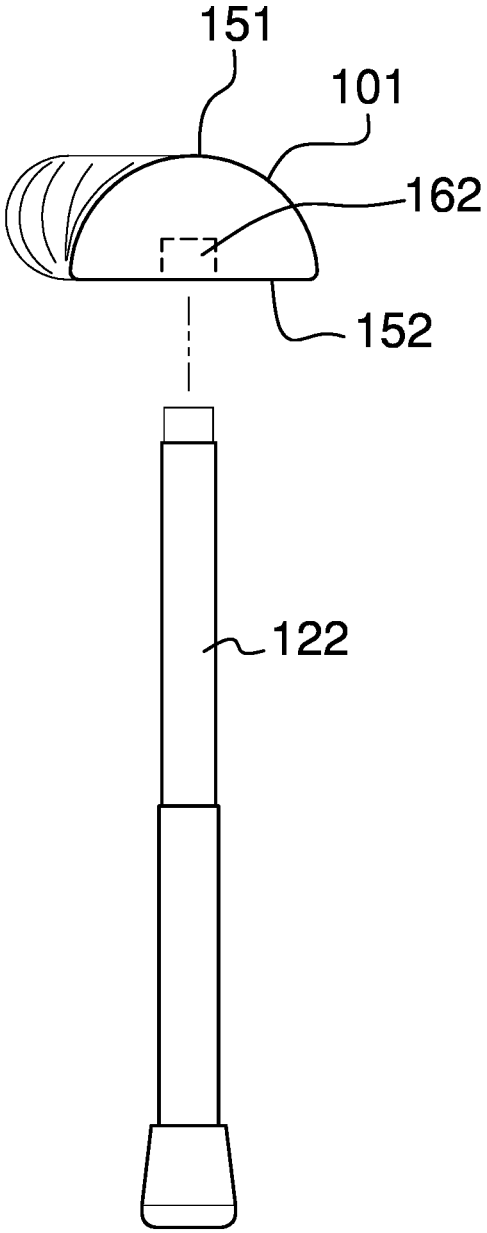
FIG. 4 is an exploded view of an embodiment of the disclosure.

Detailed reference will now be made to one or more potential embodiments of the disclosure, which are illustrated in FIGS. 1 through 4.

The portable wig and hairdressing stand 100 (hereinafter invention) is a workbench. The invention 100 is adapted for use with a cosmetic specialist 104. The invention 100 is adapted for use with the hair 106 of a client 105. The hair 106 of the client 105 is selected from the group consisting of the hair 106 growing on the client 105 and a hairpiece on a wig stand 107. The invention 100 comprises a headrest structure 101, a pedestal structure 102, and a hook and loop structure 103. The pedestal structure 102 attaches to the headrest structure 101. The hook and loop structure 103 attaches to the headrest structure 101. The headrest structure 101 forms a platform used by the cosmetic specialist 104 to work on the hair 106 of the client 105.

The cosmetic specialist 104 is defined elsewhere in this disclosure. The client 105 is defined elsewhere in this disclosure. The hair 106 is defined elsewhere in this disclosure. The wig stand 107 is an extension structure. The wig stand 107 is adapted for use with a hairpiece. The wig stand 107 elevates the hairpiece above a supporting surface.

The headrest structure 101 is a mechanical structure. The headrest structure 101 has a composite prism structure. The headrest structure 101 has a non-Euclidean structure. The headrest structure 101 forms a platform that allows the cosmetic specialist 104 to work on the hair 106 of the client 105. The headrest structure 101 rests in the lap of the cosmetic specialist 104. The headrest structure 101 is a cushioned structure. The headrest structure 101 forms a headrest. The head of the client 105 rests on the headrest structure 101 during a cosmetic procedure.

The headrest structure 101 is a single structure that is formed from three distinct sections: The first Euclidean prism structure 111, the second Euclidean prism structure 112, and the non-Euclidean prism structure 113. A congruent end of the non-Euclidean prism structure 113 joins a fixed congruent end of the first Euclidean prism structure 111 to form a composite prism structure. The congruent end of the non-Euclidean prism structure 113 that is distal from the first Euclidean prism structure 111 joins a fixed congruent end of the second Euclidean prism structure 112 to complete the composite prism structure of the headrest structure 101. The non-Euclidean shape of the non-Euclidean prism structure 113 forms the non-Euclidean composite prism structure of the headrest structure 101.

The headrest structure 101 comprises a first Euclidean prism structure 111, a second Euclidean prism structure 112, and a non-Euclidean prism structure 113.

The first Euclidean prism structure 111 is a prism shaped structure. The first Euclidean prism structure 111 is a roughly semicircular shape prism structure. The first Euclidean prism structure 111 forms a section of the composite prism structure of the headrest structure 101.

The second Euclidean prism structure 112 is a prism shaped structure. The second Euclidean prism structure 112 is a roughly semicircular shape prism structure. The second Euclidean prism structure 112 forms a section of the composite prism structure of the headrest structure 101. The form factor of the second Euclidean prism structure 112 is identical to the form factor of the first Euclidean prism structure 111. The fixed congruent end of the second Euclidean prism structure 112 attaches to the congruent end of the non-Euclidean prism structure 113 such that the center axis of the prism structure of the second Euclidean prism structure 112 aligns with the center axis of the prism structure of the first Euclidean prism structure 111.

The non-Euclidean prism structure 113 is a prism shaped structure. The non-Euclidean prism structure 113 is a roughly semicircular shape prism structure. The non-Euclidean prism structure 113 has a non-Euclidean structure. The center axis of the non-Euclidean prism structure 113 is formed with a roughly semicircular curvature. The ends of the semicircular curvature of the center axis of the non-Euclidean prism structure 113 are positioned to align with the center axes of the first Euclidean prism structure 111 and the second Euclidean prism structure 112. The semicircular curvature of the center axis of the non-Euclidean prism structure 113 creates a negative space within the form factor of the non-Euclidean prism structure 113 that follows the interior arc of the semicircular curvature of the center axis of the non-Euclidean prism structure 113.

The non-Euclidean prism structure 113 further comprises a neck notch 114. The neck notch 114 is formed by the negative space formed within the form factor of the non-Euclidean prism structure 113. The neck notch 114 forms a structure that allows the head of the client 105 to comfortably rest on the headrest structure 101.

The headrest structure 101 further comprises a first congruent end 141, a second congruent end 142, a cushioned lateral face 151, and a Euclidean lateral face 152.

The first congruent end 141 is a congruent end of the composite prism structure of the headrest structure 101. The first congruent end 141 has a roughly semicircular shape. The first congruent end 141 forms the free congruent end of the first Euclidean prism structure 111. The second congruent end 142 is a congruent end of the composite prism structure of the headrest structure 101. The second congruent end 142 has a roughly semicircular shape. The second congruent end 142 forms the free congruent end of the second Euclidean prism structure 112.

The cushioned lateral face 151 forms the superior lateral face of the composite prism structure formed by the headrest structure 101. The cushioned lateral face 151 has a semicylindrical structure that follows along the center axis of the composite prism structure of the headrest structure 101. The cushioned lateral face 151 is a cushioned structure. The head of the client 105 rests on the cushioned lateral face 151.

The Euclidean lateral face 152 forms the inferior lateral face of the composite prism structure formed by the headrest structure 101. The Euclidean lateral face 152 forms a Euclidean surface. The pedestal structure 102 attaches to the Euclidean lateral face 152. The Euclidean lateral face 152 further comprises a first mortise 161 and a second mortise 162.

The first mortise 161 is a negative space that is formed in the Euclidean lateral face 152. The first mortise 161 is formed in the first Euclidean prism structure 111 segment of the headrest structure 101. A stanchion selected from the pedestal structure 102 inserts into the first mortise 161. The second mortise 162 is a negative space that is formed in the Euclidean lateral face 152. The second mortise 162 is formed in the second Euclidean prism structure 112 segment of the headrest structure 101. A stanchion selected from the pedestal structure 102 inserts into the second mortise 162.

The pedestal structure 102 removably attaches to the Euclidean lateral face 152 of the headrest structure 101. The pedestal structure 102 is a collapsible structure. The removal of the pedestal structure 102 from the headrest structure 101 reduces the perimetrical boundary of the invention 100 for transport. The pedestal structure 102 is a load bearing structure. The pedestal structure 102 elevates the headrest structure 101 above a supporting surface. The pedestal structure 102 transfers the load of the headrest structure 101 to the supporting structure. The pedestal structure 102 further comprises a first stanchion 121 and a second stanchion 122.

The first stanchion 121 is a prism shaped structure. The superior congruent end of the first stanchion 121 forms a tenon structure that inserts into the first mortise 161 formed in the Euclidean lateral face 152 of the first Euclidean prism structure 111. The superior congruent end of the first stanchion 121 is geometrically to the first mortise 161 such that the first stanchion 121 inserts into the first mortise 161. The first stanchion 121 attaches to the Euclidean lateral face 152 of the non-Euclidean prism structure 113 of the headrest structure 101. The first stanchion 121 attaches to the first Euclidean prism structure 111 segment of the headrest structure 101.

The first stanchion 121 is a load bearing structure. The first stanchion 121 elevates the headrest structure 101 above the supporting surface. The first stanchion 121 forms a load path that transfers a portion of the load of the headrest structure 101 to the supporting surface. The first stanchion 121 is an extensible structure. The first stanchion 121 is a telescopic structure. The first stanchion 121 is an adjustable structure. The elevation of the headrest structure 101 above the supporting surface adjusts by adjusting the span of the length of the center axis of the prism structure of the first stanchion 121.

The second stanchion 122 is a prism shaped structure. The superior congruent end of the second stanchion 122 forms a tenon structure that inserts into the second mortise 162 formed in the Euclidean lateral face 152 of the second Euclidean prism structure 112. The superior congruent end of the second stanchion 122 is geometrically to the second mortise 162 such that the second stanchion 122 inserts into the second mortise 162. The second stanchion 122 attaches to the Euclidean lateral face 152 of the non-Euclidean prism structure 113 of the headrest structure 101. The second stanchion 122 attaches to the second Euclidean prism structure 112 segment of the headrest structure 101.

The second stanchion 122 is a load bearing structure. The second stanchion 122 elevates the headrest structure 101 above the supporting surface. The second stanchion 122 forms a load path that transfers a portion of the load of the headrest structure 101 to the supporting surface. The second stanchion 122 is an extensible structure. The second stanchion 122 is a telescopic structure. The second stanchion 122 is an adjustable structure. The elevation of the headrest structure 101 above the supporting surface adjusts by adjusting the span of the length of the center axis of the prism structure of the second stanchion 122.

The hook and loop structure 103 is a fastening device. The hook and loop structure 103 is a hook and loop fastener. The hook and loop structure 103 secures the wig stand 107 into the neck notch 114 of the non-Euclidean prism structure 113 of the headrest structure 101. The hook and loop structure 103 prevents the wig stand 107 from shifting while the cosmetic specialist 104 is working on the hair 106. The hook and loop structure 103 further comprises a first hook/loop surface 131 and a second hook/loop surface 132.

The first hook/loop surface 131 is a hook/loop surface selected from the hook and loop structure 103. The first hook/loop surface 131 permanently attaches to the first Euclidean prism structure 111. The second hook/loop surface 132 is a hook/loop surface selected from the hook and loop structure 103. The second hook/loop surface 132 permanently attaches to the second Euclidean prism structure 112. The second hook/loop surface 132 and the first hook/loop surface 131 combine to form the hook and loop structure 103. The second hook/loop surface 132 attaches to the first hook/loop surface 131 by pressing the second hook/loop surface 132 against the first hook/loop surface 131. The second hook/loop surface 132 attaches to the first hook/loop surface 131 to bind the wig stand 107 to the neck notch 114 of the non-Euclidean prism structure 113.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Angle: As used in this disclosure, an angle is a measure of a region between two intersecting lines or surfaces.

Arc: As used in this disclosure, an arc refers to a portion of a circumference or a curved perimeter. When applied to an angle or cant, the arc also refers to a measure of an angular span as measured from a circle at the vertex formed by the sides of the angle.

Arc, Interior: As used in this disclosure, an interior arc is a curved edge that is formed in the perimeter of an area wherein the interior arc forms a concave curve from the perspective of the interior of the area bounded by the perimeter.

Bind: As used in this disclosure, to bind is a verb that means to tie or secure a first object to a second object using a strap, cord, or webbing. Bind can also mean to tie or secure a plurality of similar first objects together by wrapping a second object around the plurality of similar first objects.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Client: As used in this disclosure, a client is an individual who is designated to receive a service.

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume. Always use perimetrical boundary Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Cosmetic: As used in this disclosure, cosmetic is an adjective that refers to a substance, a process, a procedure, or a device that is intended to improve the appearance of an individual or biological entity. By substance is meant a chemical compound such as a cosmetic media or pharmacologically active media. A cosmetic specialist is an individual who is designated to provide cosmetic services to a client.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a pad or pillow formed from soft material that is used for resting, sleeping, or reclining.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Extensible: As used in this disclosure, extensible is an adjective that describes an object made of sections that fit or together such that the object can be made longer or shorter by adjusting the relative positions of the sections.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Ferrule: As used in this disclosure, a ferrule is a prism-shaped device that inserts into the end of a prism-shaped structure such that the center axis of the prism-shaped device is aligned with the center axis of the prism-shaped structure to form a composite prism structure. The outer dimension of the prism-shaped device is lesser than the outer dimension of the prism-shaped structure. Objects attached to the prism shaped device are thereby attached to the prism shaped structure in the manner of a mortise and tenon.

Fixed and Free End: As used in this disclosure, a fixed end refers to the congruent end of a first prism shaped structure that is associated with a first object that is secured to a second structure (such as an anchor point) of the first object. A free end refers to the congruent end of the first prism shaped structure of the first object that is not secured to the second structure of the first object. Examples of the prism shaped object include, but are not limited to. shafts, pipes, tubes, cords, webbings, and wires. The free end of the first prism shaped structure can be attached to a second object. For example, the free end of the arm (first prism shaped structure) of a u-shaped structure (the first object) can be used as a tenon that inserts into a mortise contained in a second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hair: As used in this disclosure, hair is refers to the fibrous keratin-based structure commonly seen growing from the skin of mammals.

Hairpiece: As used in this disclosure, a hairpiece is device that is used to augment the natural hair of a person for fashion or cosmetic purposes. A hairpiece may contain either natural hair or artificial hair to make this augmentation. Toupee, wig, and hair extension are synonyms for a hairpiece.

Head: As used in this disclosure, the head refers to the structures of a body that are associated with a skull.

Headrest: As used in this disclosure, a headrest is a cushion used to support the head of a person.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mortise: As used in this disclosure, a mortise is a negative formed in a material that is designed to receive a similarly shaped object such that the similarly shaped object is flush to the interior surfaces of the formed by the mortise. Frictional forces between the mortise and the tenon are often used to secure the tenon within the mortise.

Neck: As used in this disclosure, the neck refers to the portion of a biological entity that attaches the head of the biological entity to the torso of the biological entity.

Negative Space: As used in this disclosure, negative space is a method of defining an object through the use of open or empty space as the definition of the object itself, or, through the use of open or empty space to describe the boundaries of an object.

Non-Euclidean Line: A non-Euclidean line is a line that is formed with a curvature. Specifically, a non-Euclidean line comprises a set of points wherein the path of the span of the shortest distance between at least two points selected from the line does not lie on the path of the line itself. When a non-Euclidean line forms a section of the perimeter of a structure, the non-Euclidean line is often called a non-Euclidean edge.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different Notch: As used in this disclosure, a notch is: 1) an indentation formed in an edge; or 2) a cavity or aperture formed within a surface.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Portable: As used in this disclosure, the term portable refers to an object with a form factor and weight that allows an individual to physically carry or manually transport the object to its intended destination.

Platform: As used in this disclosure, a platform is a raised horizontal surface that forms a load path to support objects placed on the superior surface of the platform.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Roughly: As used in this disclosure, roughly refers to a comparison between two objects. Roughly means that the difference between one or more parameters of the two compared objects are not significantly different.

Semicircle: As used in this disclosure, a semicircle refers to a planar structure that is formed as one-half of a circle. The circle that forms the semicircle is bisected by a line that passes through the center point of the circle.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Skull: As used in this disclosure, the skull refers to a bone structure that encloses the brain of a human body. The skull comprises six primary cranial bones and a plurality of other bones. The six primary cranial bones comprise: the frontal bone, the left parietal bone, the right parietal bone, the left temporal bone, the right temporal bone, and the occipital bone. The frontal bone forms the superior anterior enclosure of approximately anterior portions of the brain. The left parietal bone encloses the left posterior region from the superior side. The right parietal bone encloses the right posterior region from the superior side. The left temporal bone encloses the left posterior region from the inferior side. The right temporal bone encloses the right posterior region from the inferior side. The occipital bone encloses the posterior region of the brain from the inferior side. The left temple is the location of the skull where the frontal bone, the left parietal bone, and the left temporal bone are joined. The right temple is the location of the skull where the frontal bone, the right parietal bone, and the right temporal bone are joined.

Sphere: As used in this disclosure, a sphere refers to a structure wherein every point of the surface of the structure is equidistant from a center point. A circle refers to the two dimensional structure that that is projected onto the bifurcating plane of a spherical section by the surface of the sphere. All the points of the circle are equidistant from a center point that is found by the perpendicular projection of the center of the sphere on the bifurcating plane.

Spherical Section: As used in this disclosure, a spherical section refers one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap. The term spherical section is also applied to a semi-spherical structure.

Stanchion: As used in this disclosure, a stanchion refers to a vertically oriented prism-shaped pole, post, or support.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Table: As used in this disclosure, a table is a furniture item that provides a horizontal surface elevated above a supporting surface. The raised horizontal surface is often called the table top. The table is an extension apparatus that forms a load path between items placed on the elevated horizontal surface and the supporting surface on which the table rests.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Textile: As used in this disclosure, a textile is a material that is woven, knitted, braided, or felted. Synonyms in common usage for this definition include fabric and cloth. The two surfaces of the textile with the greatest surface area are called the faces of the textile.

Torso: As used in this disclosure, the torso refers to the portion of a human body between the neck and the pelvis. The spine is primarily contained within the torso.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A portable wig and hairdressing stand comprising a headrest structure, a pedestal structure, and a hook and loop structure;

wherein the pedestal structure attaches to the headrest structure;

wherein the hook and loop structure attaches to the headrest structure;

wherein the headrest structure further comprises a first congruent end, a second congruent end, a cushioned lateral face, and a Euclidean lateral face;

wherein the pedestal structure removably attaches to the Euclidean lateral face of the headrest structure;

wherein the pedestal structure is a collapsible structure;

wherein the removal of the pedestal structure from the headrest structure reduces a perimetrical boundary of the portable wig and hairdressing stand for transport;

wherein the pedestal structure is a load bearing structure;

wherein the pedestal structure elevates the headrest structure above a supporting surface;

wherein the pedestal structure transfers the load of the headrest structure to the supporting structure;

wherein the portable wig and hairdressing stand is adapted for use with a cosmetic specialist;

wherein the portable wig and hairdressing stand is adapted for use with the hair of a client;

wherein the hair of the client is selected from the group consisting of the hair growing on the client and a hairpiece on a wig stand;

wherein the headrest structure forms a platform used by the cosmetic specialist to work on the hair of the client;

wherein the headrest structure is a mechanical structure;

wherein the headrest structure has a composite structure;

wherein the headrest structure has a non-Euclidean structure;

wherein the headrest structure forms a platform that allows the cosmetic specialist to work on the hair of the client;

wherein the first congruent end is a congruent end of the composite structure of the headrest structure;

wherein the first congruent end has a roughly semicircular shape;

wherein the first congruent end forms the free congruent end of the first Euclidean structure;

wherein the second congruent end is a congruent end of the composite structure of the headrest structure;

wherein the second congruent end has a roughly semicircular shape;

wherein the second congruent end forms the free congruent end of the second Euclidean structure;

wherein the cushioned lateral face forms the superior lateral face of the composite structure formed by the headrest structure;

wherein the cushioned lateral face has a semi-cylindrical structure that follows along the center axis of the composite structure of the headrest structure;

wherein the cushioned lateral face is a cushioned structure;

wherein the Euclidean lateral face forms the inferior lateral face of the composite structure formed by the headrest structure;

wherein the Euclidean lateral face forms a Euclidean surface;

wherein the headrest structure is a single structure that is formed from three distinct sections;

wherein the three distinct sections comprises a first Euclidean structure, a second Euclidean structure, and a non-Euclidean structure;

wherein a congruent end of the non-Euclidean structure joins a fixed congruent end of the first Euclidean structure to form a composite structure;

wherein the congruent end of the non-Euclidean structure that is distal from the first Euclidean structure joins a fixed congruent end of the second Euclidean structure to complete the composite structure of the headrest structure;

wherein the non-Euclidean shape of the non-Euclidean structure forms the non-Euclidean composite structure of the headrest structure.

2. The portable wig and hairdressing stand according to claim 1 wherein the hook and loop structure is a fastening device;

wherein the hook and loop structure is a hook and loop fastener;

wherein the hook and loop structure secures the wig stand into the neck notch of the non-Euclidean structure of the headrest structure;

wherein the hook and loop structure prevents the wig stand from shifting while the cosmetic specialist is working on the hair.

3. The portable wig and hairdressing stand according to claim 2 wherein the first Euclidean structure is a roughly semicircular shaped structure;

wherein the first Euclidean structure forms a section of the composite structure of the headrest structure;

wherein the second Euclidean structure is a roughly semicircular shape structure;

wherein the second Euclidean structure forms a section of the composite structure of the headrest structure;

wherein the form factor of the second Euclidean structure is identical to the form factor of the first Euclidean structure;

wherein the fixed congruent end of the second Euclidean structure attaches to the congruent end of the non-Euclidean structure such that the center axis of the second Euclidean structure aligns with the center axis of the first Euclidean structure.

4. The portable wig and hairdressing stand according to claim 3 wherein the non-Euclidean structure is a roughly semicircular shape structure;

wherein the non-Euclidean structure has a non-Euclidean structure;

wherein the center axis of the non-Euclidean structure is formed with a roughly semicircular curvature;

wherein the ends of the semicircular curvature of the center axis of the non-Euclidean structure are positioned to align with the center axes of the first Euclidean structure and the second Euclidean structure;

wherein the semicircular curvature of the center axis of the non-Euclidean structure creates a negative space within the form factor of the non-Euclidean structure that follows the interior arc of the semicircular curvature of the center axis of the non-Euclidean structure;

wherein the non-Euclidean structure further comprises a neck notch;

wherein the neck notch is formed by the negative space formed within the form factor of the non-Euclidean structure;

wherein the neck notch forms a structure that allows the head of the client to comfortably rest on the headrest structure.

5. The portable wig and hairdressing stand according to claim 4 wherein the Euclidean lateral face further comprises a first mortise and a second mortise;

wherein the first mortise is a negative space that is formed in the Euclidean lateral face;

wherein the first mortise is formed in the first Euclidean structure segment of the headrest structure;

wherein the second mortise is a negative space that is formed in the Euclidean lateral face;

wherein the second mortise is formed in the second Euclidean structure segment of the headrest structure.

6. The portable wig and hairdressing stand according to claim 5 wherein the pedestal structure further comprises a first stanchion and a second stanchion;

wherein the first stanchion attaches to the first Euclidean structure segment of the headrest structure;

wherein the second stanchion attaches to the second Euclidean structure segment of the headrest structure.

7. The portable wig and hairdressing stand according to claim 6 wherein the superior congruent end of the first stanchion forms a tenon structure that inserts into the first mortise formed in the Euclidean lateral face of the first Euclidean structure;

wherein the superior congruent end of the first stanchion is geometrically to the first mortise such that the first stanchion inserts into the first mortise;

wherein the first stanchion attaches to the Euclidean lateral face of the non-Euclidean structure of the headrest structure;

wherein the first stanchion is a load bearing structure;

wherein the first stanchion elevates the headrest structure above the supporting surface;

wherein the first stanchion forms a load path that transfers a portion of the load of the headrest structure to the supporting surface;

wherein the first stanchion is an extensible structure;

wherein the first stanchion is a telescopic structure;

wherein the first stanchion is an adjustable structure;

wherein the elevation of the headrest structure above the supporting surface adjusts by adjusting the span of the length of the center axis of the first stanchion;

wherein the superior congruent end of the second stanchion forms a tenon structure that inserts into the second mortise formed in the Euclidean lateral face of the second Euclidean structure;

wherein the superior congruent end of the second stanchion is geometrically to the second mortise such that the second stanchion inserts into the second mortise;

wherein the second stanchion attaches to the Euclidean lateral face of the non-Euclidean structure of the headrest structure;

wherein the second stanchion is a load bearing structure;

wherein the second stanchion elevates the headrest structure above the supporting surface;

wherein the second stanchion forms a load path that transfers a portion of the load of the headrest structure to the supporting surface;

wherein the second stanchion is an extensible structure;

wherein the second stanchion is a telescopic structure;

wherein the second stanchion is an adjustable structure;

wherein the elevation of the headrest structure above the supporting surface adjusts by adjusting the span of the length of the center axis of the second stanchion.

8. The portable wig and hairdressing stand according to claim 7 wherein the hook and loop structure further comprises a first hook/loop surface and a second hook/loop surface;

wherein the first hook/loop surface is a hook/loop surface selected from the hook and loop structure;

wherein the first hook/loop surface permanently attaches to the first Euclidean structure;

wherein the second hook/loop surface is a hook/loop surface selected from the hook and loop structure;

wherein the second hook/loop surface permanently attaches to the second Euclidean structure;

wherein the second hook/loop surface and the first hook/loop surface combine to form the hook and loop structure;

wherein the second hook/loop surface attaches to the first hook/loop surface by pressing the second hook/loop surface against the first hook/loop surface;

wherein the second hook/loop surface attaches to the first hook/loop surface to bind the wig stand to the neck notch of the non-Euclidean structure.

* * * * *